US010036300B2

(12) United States Patent
Park et al.

(10) Patent No.: US 10,036,300 B2
(45) Date of Patent: Jul. 31, 2018

(54) WATER JACKET FOR CYLINDER BLOCK

(71) Applicants: Hyundai Motor Company, Seoul (KR); Kia Motors Corporation, Seoul (KR)

(72) Inventors: Cheol Soo Park, Hwaseong-si (KR); Bonghoon Han, Seoul (KR); Kwang Min Kim, Seongnam-si (KR); Dong Suk Chae, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/159,586

(22) Filed: May 19, 2016

(65) Prior Publication Data

US 2017/0167354 A1 Jun. 15, 2017

(30) Foreign Application Priority Data

Dec. 14, 2015 (KR) ..... 10-2015-0178142

(51) Int. Cl.
*F01P 3/02* (2006.01)
*F02F 1/14* (2006.01)
(Continued)

(52) U.S. Cl.
CPC ..... *F01P 3/02* (2013.01); *F02F 1/14* (2013.01); *F01P 2003/021* (2013.01);
(Continued)

(58) Field of Classification Search
CPC ..... F01P 3/02; F01P 2003/028; F02F 1/108; F02F 1/24; F02F 1/26; F02F 1/40; F02F 1/14
(Continued)

(56) References Cited

U.S. PATENT DOCUMENTS

2005/0235930 A1* 10/2005 Xin ..... F02F 1/14 123/41.74
2008/0283001 A1* 11/2008 Konishi ..... F02F 1/108 123/41.72
(Continued)

FOREIGN PATENT DOCUMENTS

JP 08-326534 A 12/1996
JP 2005-120949 A 5/2005
(Continued)

*Primary Examiner* — Jacob Amick
*Assistant Examiner* — Charles Brauch
(74) *Attorney, Agent, or Firm* — Morgan, Lewis & Bockius LLP

(57) ABSTRACT

A water jacket for a cylinder block may include a first main body formed inside the cylinder block at a first side thereof, and a second main body formed at a second side thereof, and in which coolant flows, a first sub-body formed at an upper portion of the first main body, and a second sub-body formed at an upper portion of the second main body, each of the first and second sub-bodies being connected to an inside of a cylinder head to flow a coolant into an upper portion of the cylinder block and the cylinder head, a first insert member disposed between the first main body and the first sub-body to partition the first main body and the first sub-body, and a second insert member disposed between the second main body and the second sub-body to partition the second main body and the second sub-body.

7 Claims, 4 Drawing Sheets

(51) Int. Cl.

| | |
|---|---|
| *F02F 1/24* | (2006.01) |
| *F02F 1/26* | (2006.01) |
| *F02F 1/40* | (2006.01) |
| *F02F 1/10* | (2006.01) |

(52) U.S. Cl.
CPC ..... *F01P 2003/028* (2013.01); *F02F 1/108* (2013.01); *F02F 1/24* (2013.01); *F02F 1/26* (2013.01); *F02F 1/40* (2013.01)

(58) Field of Classification Search
USPC ..... 123/41.74
See application file for complete search history.

(56) References Cited

U.S. PATENT DOCUMENTS

| | | | | |
|---|---|---|---|---|
| 2009/0194046 | A1* | 8/2009 | Shikida ..... | F02F 1/14<br>123/41.74 |
| 2010/0242868 | A1* | 9/2010 | Shikida ..... | F01P 3/02<br>123/41.79 |
| 2012/0240883 | A1* | 9/2012 | McGiffin ..... | F02F 1/16<br>123/41.72 |
| 2014/0345547 | A1* | 11/2014 | Lee ..... | F01P 7/165<br>123/41.1 |

FOREIGN PATENT DOCUMENTS

| | | | |
|---|---|---|---|
| JP | 2005-315118 | A | 11/2005 |
| JP | 2008-025474 | A | 2/2008 |

* cited by examiner

WATER JACKET FOR CYLINDER BLOCK

CROSS-REFERENCE TO RELATED APPLICATION

The present application claims priority to Korean Patent Application No. 10-2015-0178142 filed Dec. 14, 2015, the entire contents of which is incorporated herein for all purposes by this reference.

BACKGROUND OF THE INVENTION

Field of the Invention

The present invention relates to a water jacket for a cylinder block. More particularly, the present invention relates to a water jacket for a cylinder that may improve overall cooling efficiency of the cylinder block by controlling coolant flow inside the cylinder block.

Description of Related Art

Generally, some of heat generated in a combustion chamber of an engine is absorbed by a cylinder head, a cylinder block, intake and exhaust valves, a piston, etc.

When temperatures of the constituent components of the engine excessively increase, the constituent components may be thermally deformed, or an oil film of an inner wall of a cylinder may be damaged such that lubrication performance deteriorates, resulting in thermal problems of the engine.

Due to the thermal problems of the engine, abnormal combustion such as combustion failure, knocking, etc. occurs, thus a piston may be melted, which may result in serious damage to the engine. Further, thermal efficiency and power of the engine may deteriorate. In contrast, excessive cooling of the engine may cause the power and fuel consumption to deteriorate, and may cause low temperature abrasion of the cylinder, thus it is necessary to appropriately control temperature of the coolant.

In this respect, in a typical engine, a water jacket is provided inside a cylinder block and a cylinder head, and a coolant circulating in the water jacket cools a periphery of a spark plug corresponding to a combustion chamber and metal surfaces such as peripheries of an exhaust port, a valve seat, etc.

However, in the typical engine, since the coolant flowing in according to the order of cylinders is sequentially circulated in the water jacket provided in the cylinder block, portions of the cylinder block corresponding to upper and lower portions of the combustion chamber at which a relative temperature difference is generated are not effectively cooled, such that the engine is not entirely fully cooled.

In addition, durability of the engine deteriorates due to the poor cooling efficiency of the engine, and if a separate cooling jet is provided and a high performance water pump is used in order to prevent the deterioration of the durability of the engine, costs thereof may increase.

Further, when the temperature of the coolant is low, viscosity of engine oil is high, thus as frictional force increases, fuel consumption increases, that is, fuel efficiency deteriorates, while when the coolant temperature is excessively high, since knocking occurs, performance of the engine may deteriorate by adjusting ignition timing in order to suppress the knocking.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a water jacket for a cylinder block that may improve cooling efficiency of an engine to increase durability thereof by implementing separate variable cooling in which some of a coolant flowing in a cylinder block separately flows in an upper portion of the cylinder block connected to a cylinder head and a coolant flow is controlled according to a driving state of a vehicle, and that may improve fuel efficiency by prevent knocking occurrence and reducing friction loss through temperature control of the cylinder block.

According to various aspects of the present invention, a water jacket for a cylinder block, inside of which a plurality of combustion chambers are disposed and on an upper portion of which a cylinder head is mounted may include a first main body formed inside the cylinder block along a length direction thereof at a first side thereof, and a second main body formed along the length direction at a second side thereof based on a width direction of a vehicle, and in which coolant flows, a first sub-body formed at an upper portion of the first main body, and a second sub-body formed at an upper portion of the second main body, each of the first and second sub-bodies being connected to an inside of the cylinder head to flow a coolant into an upper portion of the cylinder block and the cylinder head, a first insert member disposed between the first main body and the first sub-body to partition the first main body and the first sub-body, and a second insert member disposed between the second main body and the second sub-body to partition the second main body and the second sub-body.

The first and second main bodies may be divided and cooled in the width direction of the vehicle inside the cylinder block.

A plurality of first and second connecting parts protruding toward the cylinder head between respective combustion chambers may be integrally formed at the first and second sub-bodies.

A gasket may be disposed between the cylinder block and the cylinder head, and the gasket may be formed to have through-holes through which the first and second connecting parts are inserted.

The first and second sub-bodies may upwardly protrude from the first and second insert members by predetermined lengths so that coolants are constantly supplied to the cylinder head through the first and second connecting parts.

First and second reflectors bent toward the cylinder head may be formed at rear sides of the first and second insert members so that a coolant is not discharged to an outside of the cylinder block from the first and second sub-bodies and the first and second connecting parts which are positioned at a rear based on a longitudinal direction of the vehicle.

The first and second reflectors may be formed to integrally extend from the rear sides of the first and second insert members and to be roundly bent toward the cylinder head.

The first and second reflectors may partition the first and second connecting parts which are positioned at the rear based on the longitudinal direction of the vehicle such that a coolant flows into the cylinder head.

Front sides of the first and second insert members may protrude from the first and second main bodies and the first and second sub-bodies, and contact each other.

An inflow hole through which a coolant flows may be provided at a front side of the first main body based on a longitudinal direction of the vehicle.

A block thermostat for controlling a coolant flow depending on a temperature of the coolant discharged from the first main body through the inflow hole may be provided at a rear inside of the cylinder block.

According to various embodiments of the present invention, it is possible to improve cooling efficiency of the engine to increase durability thereof by implementing separate variable cooling in which some of a coolant flowing in a cylinder block separately flows in an upper portion of the cylinder block connected to a cylinder head and a coolant flow is bi-directionally controlled in a width direction of the cylinder block according to a driving state of a vehicle.

In addition, according to various embodiments of the present invention, since it is possible to control the temperature of the cylinder block according to the driving state of the vehicle, knocking occurrence may be minimized, thereby reducing an amount of blow-by gas and minimizing adjustment of the ignition timing.

Further, according to various embodiments of the present invention, since it is possible to reduce a friction loss by decreasing viscosity of the engine oil, undesirable fuel consumption may be prevented and fuel efficiency may be improved.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
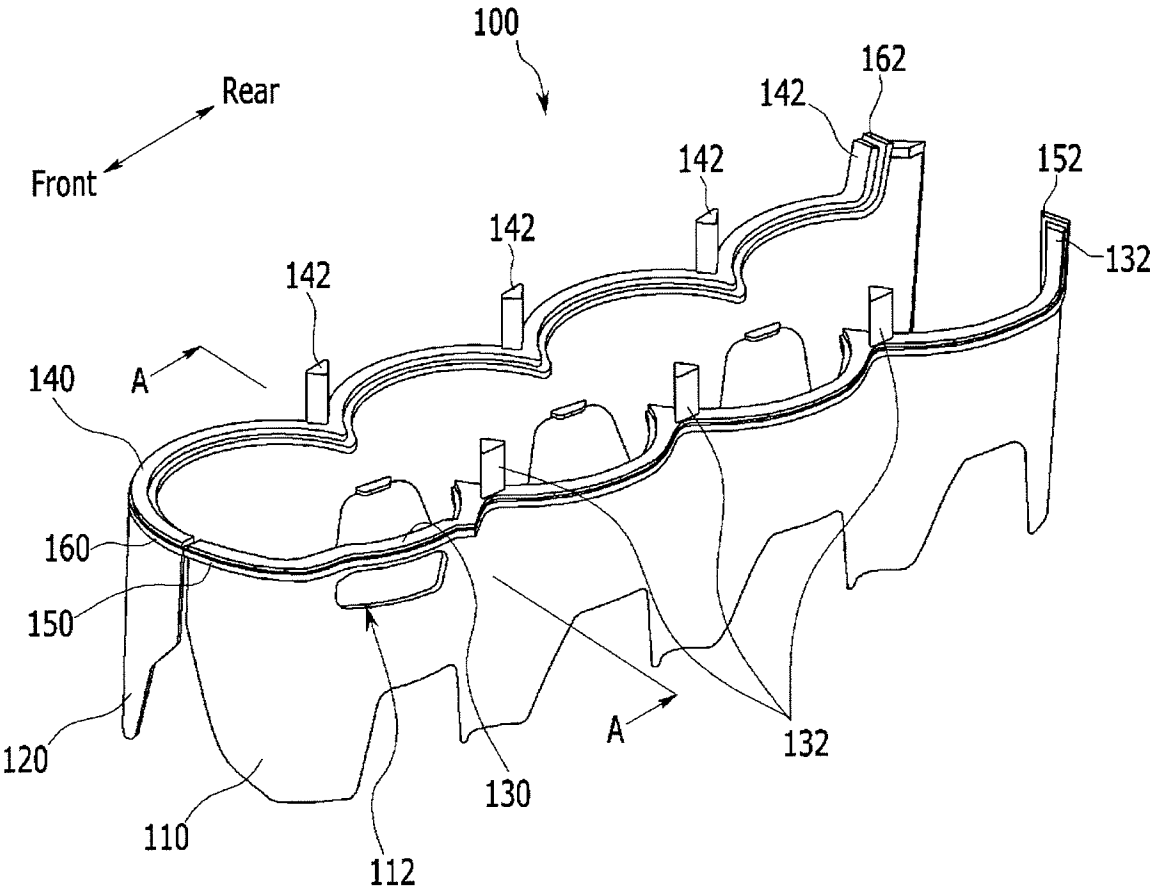
FIG. 1 illustrates a perspective view of an exemplary water jacket for a cylinder block according to the present invention.
Figure 2:
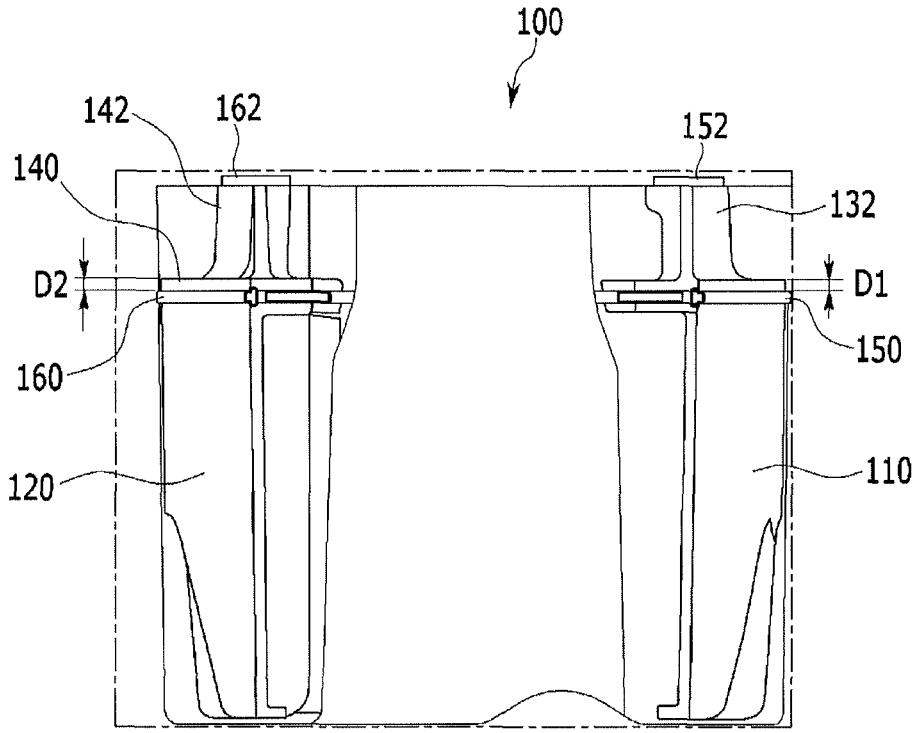
FIG. 2 illustrates a front view of the exemplary water jacket for a cylinder block according to the present invention.
Figure 3:
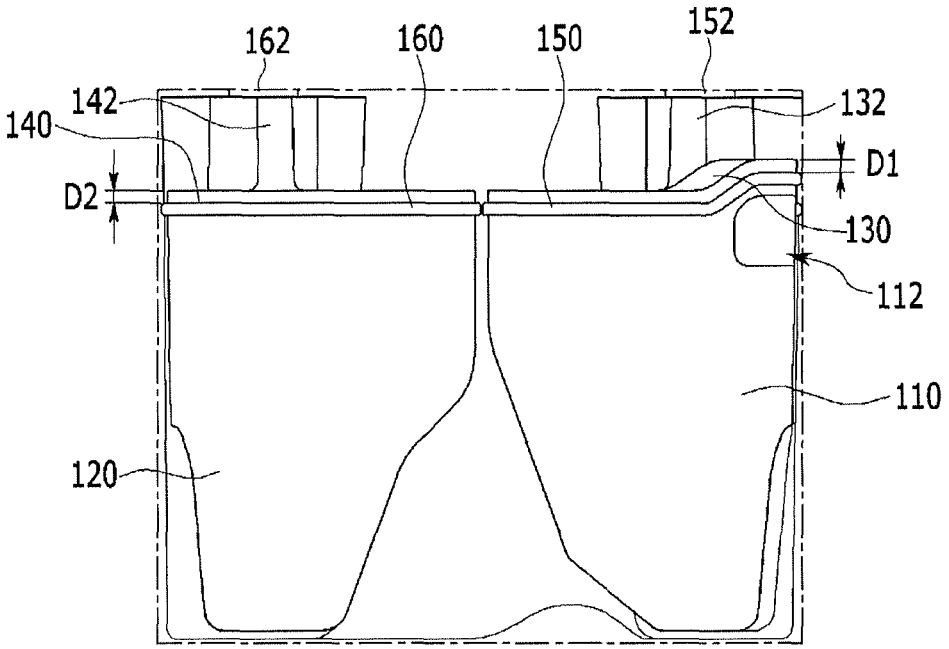
FIG. 3 illustrates a cross-sectional view taken along line A-A of FIG. 1.
Figure 4:
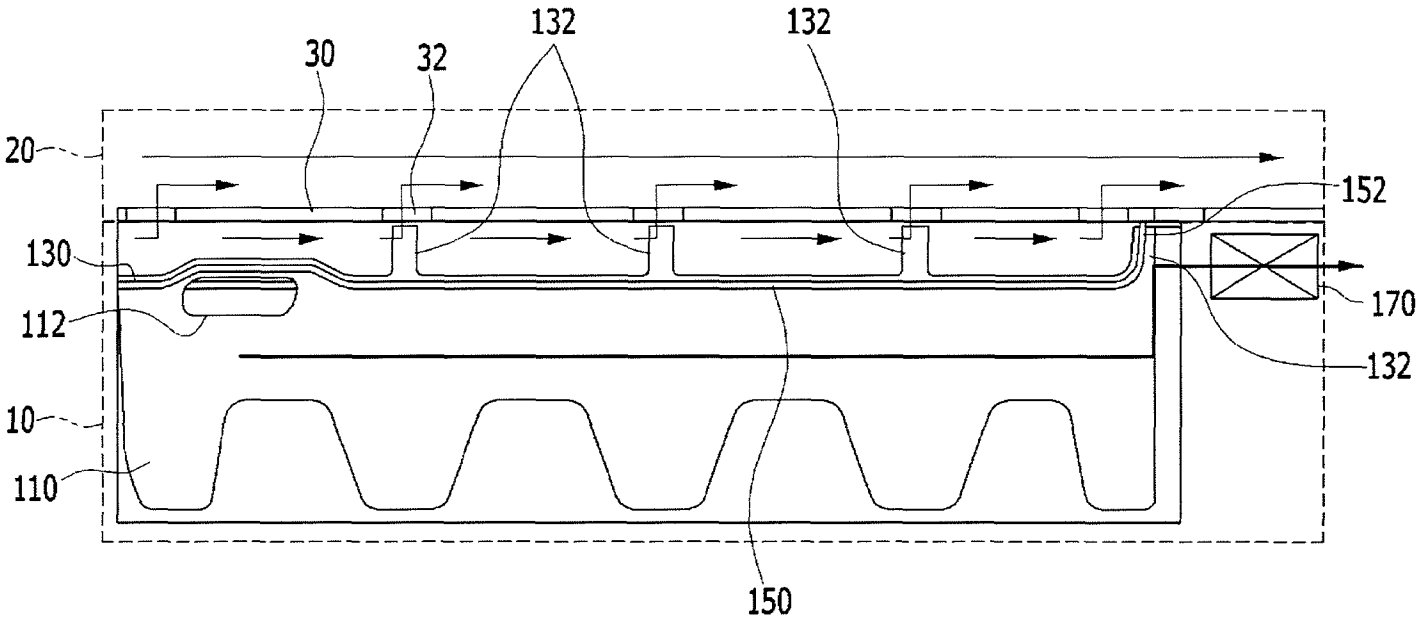
FIG. 4 illustrates a state in which the exemplary water jacket for a cylinder block according to the present invention is used.

FIG. 1 illustrates a perspective view of a water jacket for a cylinder block according to various embodiments of the present invention, FIG. 2 illustrates a front view of the water jacket for the cylinder block according to various embodiments of the present invention, FIG. 3 illustrates a cross-sectional view taken along line A-A of FIG. 1, and FIG. 4 illustrates a state in which the water jacket for the cylinder block according to various embodiments of the present invention is used.

A water jacket 100 for a cylinder block according to various embodiments of the present invention cools the cylinder block 10 inside of which a plurality of combustion chambers are provided and on an upper portion thereof a cylinder head 20 is mounted.

For this purpose, the water jacket 100 for the cylinder block according to the various embodiments of the present invention, as shown in FIG. 1 to FIG. 3, includes first and second main bodies 110 and 120, first and second sub-bodies 130 and 140, and first and second insert members 150 and 160.

The first main body 110 is formed inside the cylinder block 10 along a length direction thereof at one side thereof based on a width direction of a vehicle, and a coolant flows in the first main body 110.

The second main body 120 corresponds to the first main body 110, that is, it is formed inside the cylinder block 10 along the length direction thereof at the other side thereof based on the width direction of the vehicle, and a coolant flows in the second main body 120.

The first main body 110 and the second main body 120 are separately formed inside the cylinder block 10. Accordingly, the first main body 110 and the second main body 120 may be separately divided and cooled in the width direction of the vehicle inside the cylinder block 10.

The first sub-body 130 is formed at an upper portion of the first main body 110, and may be connected to the water jacket of the cylinder head 20 to flow a coolant into an upper portion of the cylinder block 10 and the cylinder head 20.

The second sub-body 140 is formed at an upper portion of the second main body 120, and may be connected to the water jacket of the cylinder head 20 to flow a coolant into an upper portion of the cylinder block 10 and the cylinder head 20.

The first insert member 150 is installed between the first main body 110 and the first sub-body 130 to partition the first main body 110 and the first sub-body 130.

Thus, a coolant may be divided into the first main body 110 and the first sub-body 130 to separately flow.

The second insert member 160 is installed between the second main body 120 and the second sub-body 140 to partition the second main body 120 and the second sub-body 140.

Thus, a coolant may be divided into the second main body 120 and the second sub-body 140 to separately flow.

A plurality of first and second connecting parts 132 and 142 protruding toward the cylinder head 20 between respective combustion chambers may be integrally formed at the first sub-body 130 and the second sub-body 140, respectively.

The first connecting part 132 and the second connecting part 142 may be respectively formed at the first sub-body 130 and the second sub-body 140, which are respectively positioned between the combustion chambers formed in a longitudinal direction of the vehicle and at a rear side of the endmost combustion chamber.

A gasket 30 is provided between the cylinder block 10 and the cylinder head 20. The gasket 30 may be formed to have through-holes 32 through which the first connecting part 132 and the second connecting part 142 may be inserted.

That is, the first connecting part 132 and the second connecting part 142 may supply a coolant to the water jacket of the cylinder head through the through-holes 32.

In various embodiments, the first sub-body 130 and the second sub-body 140 may upwardly protrude from the first and second insert members by predetermined lengths D1 and D2 so that coolants are always supplied to the upper portion of the cylinder block 10 and the cylinder head 20 which have relatively high temperatures through the first connecting part 132 and the second connecting part 142.

Here, respective front sides of the first and second insert members 150 and 160 protrude from the first and second main bodies 110 and 120 and the first and second sub-bodies 130 and 140, and they may contact each other.

In various embodiments, it is exemplarily described that the front sides of the first insert member 150 and the second insert member 160 contact each other, but the present invention is not limited thereto, and they may be formed to be spaced apart from each other.

Here, first and second reflectors 152 and 162 bent toward the cylinder head 20 may be formed at rear sides of the first and second insert members 150 and 160 based on the longitudinal direction of the vehicle so that a coolant may not be discharged to the outside of the cylinder block 10 from the first and second sub-bodies 130 and 140 and the first and second connecting parts 132 and 142 which are positioned at the rear thereof.

The first reflector 152 and the second reflector 162 may integrally extend from the rear sides of the first insert member 130 and the second insert member 140, respectively, and they may be formed to be roundly bent toward the cylinder head 20.

Since the first reflector 152 and the second reflector 162 partition the first and second connecting parts 132 and 142 which are positioned at the rear based on the longitudinal direction of the vehicle, a coolant may flow into the cylinder head 20 through the first and second sub-bodies 130 and 140 and the first and second connecting parts 132 and 142.

An inflow hole 112 through which a coolant flows in may be provided at one front side of the first main body 110 based on the longitudinal direction of the vehicle.

That is, the inflow hole 112 allows the coolant to separately flow in the first main body 110 regardless of the second main body 120.

As shown in FIG. 4, a block thermostat 170 for controlling a coolant flow depending on a temperature of the coolant discharged from the first main body 110 through the inflow hole 112 may be provided at the rear inside of the cylinder block 10.

The block thermostat 170 allows the coolant to flow or not to flow in the first main body 110 by being selectively opened or closed depending on a temperature of the coolant passing through the first main body 110.

That is, when a temperature adjustment of the cylinder block 10 is required according in a running state of the vehicle, since the block thermostat 170 operates depending on the temperature of the coolant passing through the first main body 110, the temperature of the cylinder block 10 may be efficiently adjusted.

An operation and an application of the water jacket 100 for the cylinder block according to various embodiments of the present invention, which is configured as described above, will now be described in detail.

When it is required to cool an engine during running of a vehicle, a coolant flows in through the inflow hole 112 of the first main body 110 and passes through the first main body 110.

At the same time, a coolant also passes through the second main body 120 regardless of the first main body 110.

That is, the opposite sides of the cylinder block 10 divided in the width direction of the vehicle may be separately cooled by coolants respectively passing through the first main body 110 and the second main body 120.

In addition, in a state in which the first sub-body 130 and the second sub-body 140 are separated from the first and second main bodies 110 and 120, coolants flow in the first sub-body 130 and the second sub-body 140 to cool the upper portion of the cylinder block 10.

In this case, the first and second connecting parts 132 and 142 allow some of the coolants passing through the first and second sub-bodies 130 and 140 to flow in the cylinder head 20. Here, the first and second reflectors 152 and 162 allow the coolants to constantly flow in the cylinder head 20 through the first and second connecting parts 132 and 142.

Accordingly, since the first reflector 152 and the second reflector 162 partition the first and second connecting parts 132 and 142 which are positioned at the rear based on the longitudinal direction of the vehicle, a coolant may flow into the cylinder head 20 through the first and second sub-bodies 130 and 140 and the first and second connecting parts 132 and 142.

That is, the first and second sub-bodies 130 and 140 and the first and second connecting parts 132 and 142 allow the coolants to be constantly circulated in the upper portion of the combustion chamber and the cylinder head 20 which have the relatively high temperature inside the cylinder block 10, thereby improving cooling efficiency.

Accordingly, the upper portion of the cylinder block 10 and the cylinder head 20 which are in the high temperature state are effectively cooled by using the first and second sub-bodies 130 and 140 and the first and second connecting parts 132 and 142, thus overheating of the engine may be prevented so that the knocking is prevented and the adjustment of the ignition timing may be minimized.

A lower portion of the cylinder block 10, a temperature of which is lower than that of the upper portion of the cylinder block 10, is cooled by the coolants passing through the first main body 110 and the second main body 120.

When the temperature of the lower portion of the cylinder block 10 is equal to or less than a predetermined temperature, viscosity of the engine oil decreases to increase friction loss. Accordingly, the block thermostat 170 connected to the first main body 110 allows the coolants to be selectively stopped in the first main body 110 or to pass through the first main body 110 depending on the temperature of the coolant passing through the first main body 110.

In this case, the coolant passing through the second main body 120 separately and constantly flows regardless of the first main body 110. That is, it is possible to control the temperature of the cylinder block 10 by controlling the flow of the coolant passing through the first main body 110.

Accordingly, the block thermostat 170 controls the coolant passing through the first main body 110 so that the lower portion of the cylinder block 10 is not supercooled, thus it is possible to prevent the viscosity of the engine oil from being lowered.

According to the water jacket 100 for the cylinder block of the various embodiments of the present invention, it is possible to improve cooling efficiency of the engine to increase durability thereof by implementing the separate variable cooling in which some of the coolant flowing in the cylinder block 10 separately flows in the upper portion of the cylinder block 10 connected to the cylinder head 20 and the coolant flow is bi-directionally controlled in the width direction of the cylinder block 10 according to the driving state of the vehicle.

In addition, since it is possible to control the temperature of the cylinder block 10 according to the driving state of the vehicle, knocking occurrence may be minimized, thereby reducing an amount of blow-by gas and minimizing adjustment of the ignition timing.

Further, since it is possible to reduce the friction loss by decreasing the viscosity of the engine oil, undesirable fuel consumption may be prevented and fuel efficiency may be improved.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A water jacket for a cylinder block, inside of which a plurality of combustion chambers are disposed and on an upper portion of which a cylinder head is mounted, the water jacket comprising:

a first main body formed inside the cylinder block along a length direction thereof at a first side thereof, and a second main body formed along the length direction at a second side thereof based on a width direction of a vehicle, and in which coolant flows;

a first sub-body formed at an upper portion of the first main body, and a second sub-body formed at an upper portion of the second main body, each of the first and second sub-bodies being connected to an inside of the cylinder head to flow a coolant into an upper portion of the cylinder block and the cylinder head;

a first insert member disposed between the first main body and the first sub-body to partition the first main body and the first sub-body; and a second insert member disposed between the second main body and the second sub-body to partition the second main body and the second sub-body, wherein the first and second main bodies are separately formed inside the cylinder block, and are divided and cooled in the width direction of the vehicle inside the cylinder blocks wherein a plurality of first and second connecting parts protruding toward the cylinder head between respective combustion chambers are integrally formed at the first and second sub-bodies, wherein rear sides of the first and second insert members are separated to form a first reflector on the rear side of the first insert member and to form a second reflector on the rear side of the second insert member, wherein the first and second reflectors that bend vertically toward the cylinder head are formed at the rear sides of the first and second insert members so that a coolant is not discharged to an outside of the cylinder block from the first and second sub-bodies and the first and second connecting parts which are positioned at a rear based on a longitudinal direction of the vehicle, and wherein front sides of the first and second insert members protrude from the first and second main bodies and the first and second sub-bodies, and contact each other.

2. The water jacket for the cylinder block of claim 1, wherein a gasket is disposed between the cylinder block and the cylinder head, and the gasket is formed to have through-holes through which the first and second connecting parts are inserted.

3. The water jacket for the cylinder block of claim 1, wherein the first and second sub-bodies upwardly protrude from the first and second insert members by predetermined lengths so that coolants are constantly supplied to the cylinder head through the first and second connecting parts.

4. The water jacket for the cylinder block of claim 1, wherein the first and second reflectors are formed to integrally extend from the rear sides of the first and second insert members and to be roundly bent toward the cylinder head.

5. The water jacket for the cylinder block of claim 1, wherein the first and second reflectors partition the first and second connecting parts which are positioned at the rear based on the longitudinal direction of the vehicle such that a coolant flows into the cylinder head.

6. The water jacket for the cylinder block of claim 1, wherein an inflow hole through which a coolant flows is provided at a front side of the first main body based on a longitudinal direction of the vehicle.

7. The water jacket for the cylinder block of claim 6, wherein a block thermostat for controlling a coolant flow depending on a temperature of the coolant discharged from the first main body through the inflow hole is provided at a rear inside of the cylinder block.

* * * * *